US007334709B1

(12) United States Patent
Huang

(10) Patent No.: US 7,334,709 B1
(45) Date of Patent: Feb. 26, 2008

(54) PNEUMATIC CAULKING GUN

(75) Inventor: Chi-Chuan Huang, Fuhsing Hsiang (TW)

(73) Assignee: Kai Shyun Enterprise Co., Ltd., Changhua Hsien (TW)

( * ) Notice: Subject to any disclaimer, the term of this patent is extended or adjusted under 35 U.S.C. 154(b) by 354 days.

(21) Appl. No.: 11/151,622

(22) Filed: Jun. 13, 2005

(51) Int. Cl.
*B65D 88/54* (2006.01)

(52) U.S. Cl. ..... 222/334; 222/389

(58) Field of Classification Search ..... 222/334, 222/389, 326
See application file for complete search history.

(56) References Cited

U.S. PATENT DOCUMENTS 2,183,013 A * 12/1939 Davis ..... 222/324
3,813,012 A * 5/1974 Laird ..... 222/326
3,880,331 A * 4/1975 Perkins ..... 222/327
4,113,151 A * 9/1978 Brown et al. ..... 222/324
2003/0164387 A1* 9/2003 Grach et al. ..... 222/389

* cited by examiner

*Primary Examiner*—Philippe Derakshani
(74) *Attorney, Agent, or Firm*—Alan Kamrath; Kamrath & Associates PA

(57) ABSTRACT

A pneumatic caulking gun includes a gun body, an air valve, a control unit, a trigger, a barrel, a push plate, a connecting base, a safety valve, and a push rod. Thus, the trigger is pressed to fill the pressurized air with the barrel successively to push the push plate forward to compress and squeeze the silicone gel, thereby injecting the silicone gel outward from the nozzle of the barrel automatically. In addition, the user only needs to slightly press the trigger by his one hand to squeeze the silicone gel outward, thereby facilitating the user operating the caulking gun, and thereby saving the manual work.

18 Claims, 7 Drawing Sheets

PNEUMATIC CAULKING GUN

BACKGROUND OF THE INVENTION

1. Field of the Invention

The present invention relates to a caulking gun, and more particularly to a pneumatic caulking gun that is operated easily and conveniently.

2. Description of the Related Art

A conventional caulking gun comprises a gun body, a barrel mounted on the gun body, a push plate movably mounted in the barrel, and a push rod extended through the gun body and the barrel and connected to the push plate to push the push plate to squeeze a silicone gel contained in the barrel, thereby injecting the silicone gel outward from the barrel for use with a user. However, the conventional caulking gun is operated in a manual manner, thereby greatly decreasing the working efficiency and wasting the manual work. In addition, the user holds the gun body by his one hand, and pushes the push rod by his other hand, thereby greatly causing inconvenience to the user. Further, the conventional caulking gun is operated in a manual manner, so that the silicone gel is not injected onto an object in an evenly distributed manner.

SUMMARY OF THE INVENTION

In accordance with the present invention, there is provided a pneumatic caulking gun, comprising a gun body, an air valve mounted in the gun body and provided with an air inlet pipe, an air outlet pipe and a conveying pipe, a control unit movably mounted in the air valve to control connection of the conveying pipe with the air inlet pipe and the air outlet pipe, a trigger pivotally mounted on the gun body and pressed on the control unit to control movement of the control unit, and a barrel mounted on the gun body and having a first end connected to the conveying pipe of the air valve and a second end provided with a nozzle.

The primary objective of the present invention is to provide a pneumatic caulking gun that is operated easily and conveniently.

Another objective of the present invention is to provide a pneumatic caulking gun, wherein the trigger is pressed to fill the pressurized air with the barrel successively to push the push plate forward to compress and squeeze the silicone gel, thereby injecting the silicone gel outward from the nozzle of the barrel automatically.

A further objective of the present invention is to provide a pneumatic caulking gun, wherein the user only needs to slightly press the trigger by his one hand to squeeze the silicone gel outward, thereby facilitating the user operating the caulking gun, and thereby saving the manual work.

A further objective of the present invention is to provide a pneumatic caulking gun, wherein the silicone gel is squeezed outward automatically, so that the silicone gel is injected onto an object in an evenly distributed manner, thereby enhancing the working efficiency of the caulking gun.

A further objective of the present invention is to provide a pneumatic caulking gun, wherein when the silicone gel is exhausted, the push portion of the push rod is movable to push the safety valve, thereby opening the drain hole of the connecting base, so that the pressurized air from the barrel is drained outward the drain hole of the connecting base, thereby preventing the barrel from producing a gas explosion.

Further benefits and advantages of the present invention will become apparent after a careful reading of the detailed description with appropriate reference to the accompanying drawings.

DETAILED DESCRIPTION OF THE INVENTION

Figure 1:
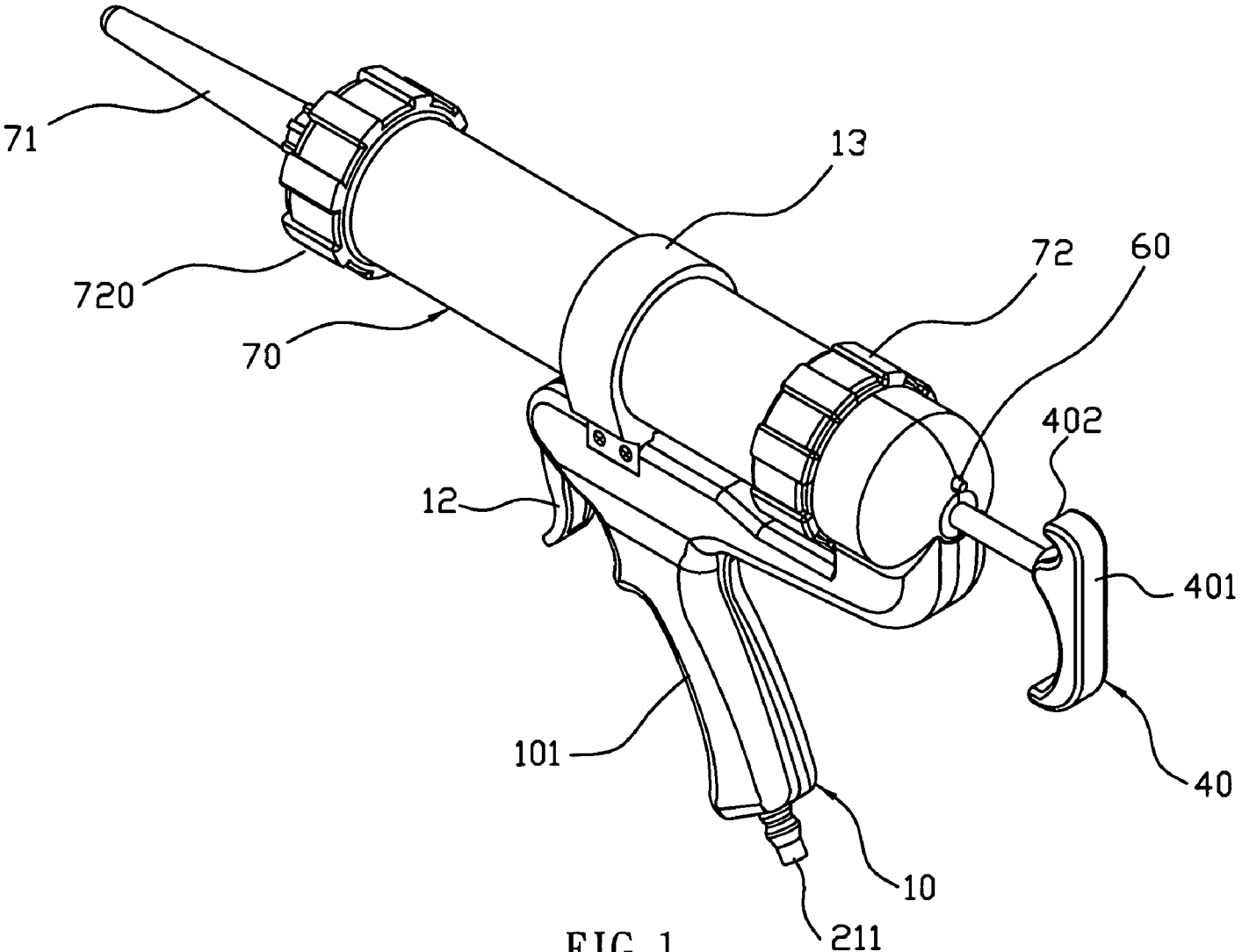
FIG. 1 is a perspective view of a pneumatic caulking gun in accordance with the preferred embodiment of the present invention.
Figure 2:
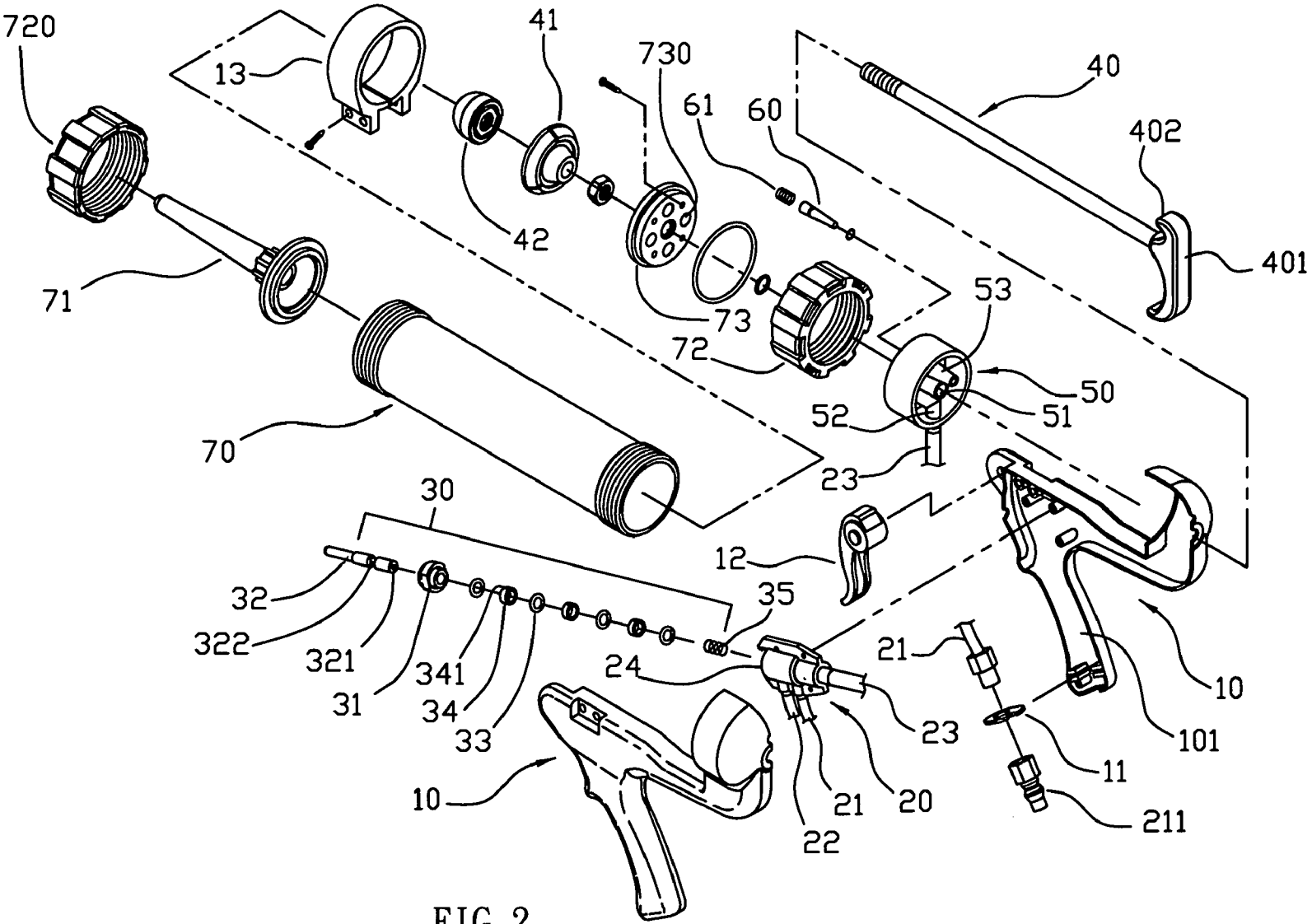
FIG. 2 is an exploded perspective view of the pneumatic caulking gun as shown in FIG. 1.
Figure 3:
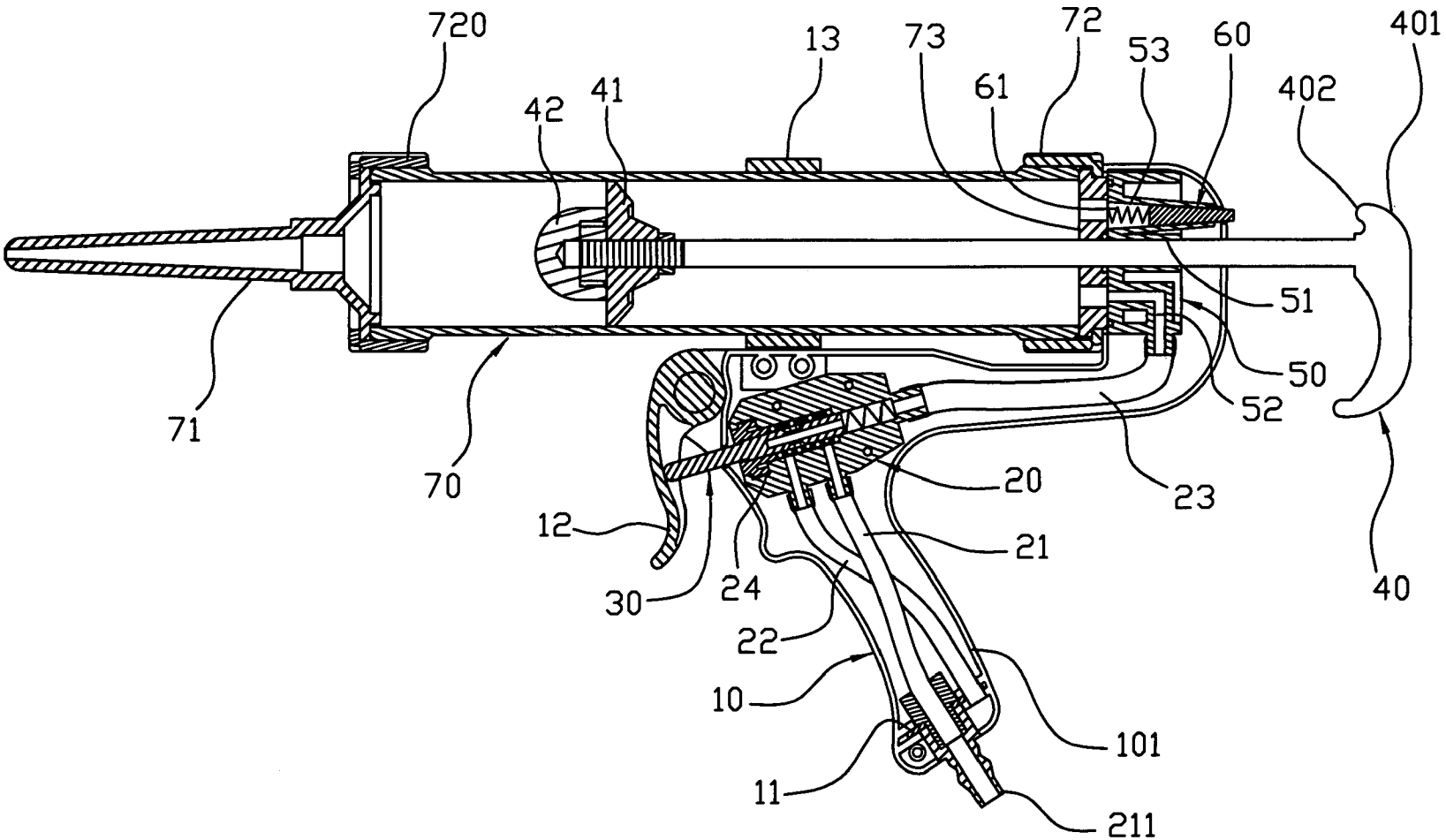
FIG. 3 is a side plan cross-sectional view of the pneumatic caulking gun as shown in FIG. 1.
Figure 4:
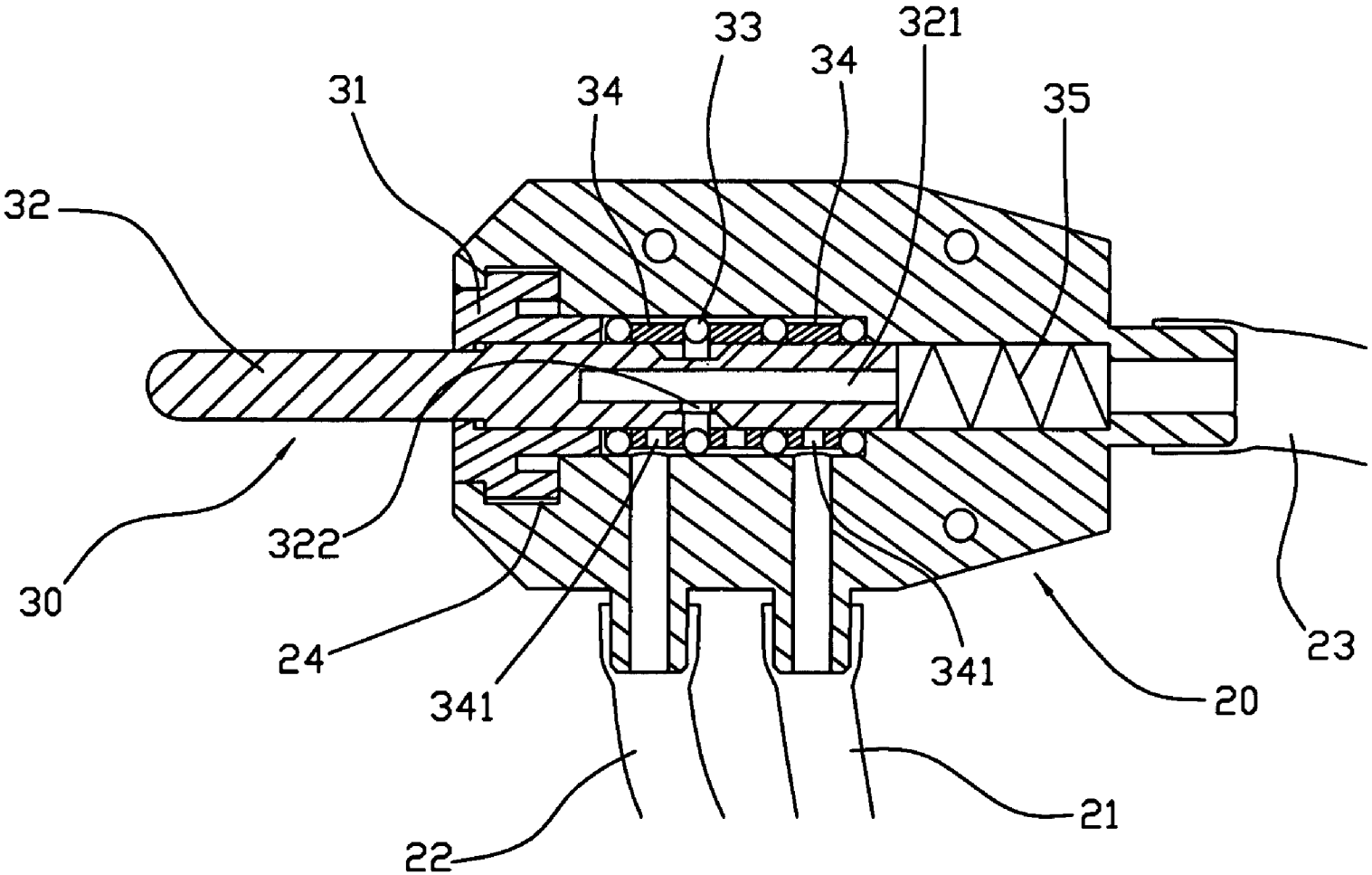
FIG. 4 is a locally enlarged view of the pneumatic caulking gun as shown in FIG. 3.

Referring to the drawings and initially to FIGS. 1-4, a pneumatic caulking gun in accordance with the preferred embodiment of the present invention comprises a gun body 10, an air valve 20 mounted in the gun body 10 and provided with an air inlet pipe 21, an air outlet pipe 22 and a conveying pipe 23, a control unit 30 movably mounted in the air valve 20 to control connection of the conveying pipe 23 with the air inlet pipe 21 and the air outlet pipe 22, a trigger 12 pivotally mounted on the gun body 10 and pressed on the control unit 30 to control movement of the control unit 30, a barrel 70 mounted on the gun body 10 by a first locking ring 72 and having a first end connected to the conveying pipe 23 of the air valve 20 and a second end provided with a nozzle 71 by a second locking ring 720, a push plate 41 movably mounted in the barrel 70, a connecting base 50 mounted on the gun body 10 and connected between the first end of the barrel 70 and the conveying pipe 23 of the air valve 20, a safety valve 60 mounted on the connecting base 50 and partially protruded outward from the gun body 10, and a push rod 40 movably mounted on the gun body 10 and having a first end secured to the push plate 41 by a push block 42 to move with the push plate 41 and a second end provided with a pull handle 401.

The gun body 10 is provided with a handle 101, the trigger 12 is pivotally mounted on the handle 101 of the gun body 10, and the air inlet pipe 21 and the air outlet pipe 22 of the air valve 20 are mounted in the handle 101 of the gun body 10 by a fixing plate 11 and connected to an outside of the gun body 10. The air inlet pipe 21 of the air valve 20 has a distal end protruded outward from the handle 101 of the gun body 10 and provided with a connector 211 for connection to a pneumatic source. A mounting ring 13 is fixed on the gun body 10 and mounted on the barrel 70 to support the barrel 70 on the gun body 10. The air valve 20 has an inside formed with a valve chamber 24 for mounting the control unit 30 and connected to the air inlet pipe 21, the air outlet pipe 22 and the conveying pipe 23.

The control unit 30 includes a press knob 32 movably mounted in the valve chamber 24 of the air valve 20 and having a first end having an inside formed with an air hole 321 connected to the conveying pipe 23 of the air valve 20 and a side formed with a connecting hole 322 connected to the air hole 321 and movable to selectively connect either one of the air inlet pipe 21 and the air outlet pipe 22 of the air valve 20, a spring 35 biased between the first end of the press knob 32 and the valve chamber 24 of the air valve 20, a plurality of spacer rings 34 and O-rings 33 mounted on the press knob 32 and arranged in a staggered manner, and an end cap 31 mounted on the press knob 32 and secured in the valve chamber 24 of the air valve 20. The press knob 32 of the control unit 30 has a second end protruded outward from the air valve 20 and rested on the trigger 12. Each of the spacer rings 34 of the control unit 30 is formed with a through hole 341 connected to either one of the air inlet pipe 21 and the air outlet pipe 22 of the air valve 20 respectively.

The connecting base 50 has an inside formed with a conduit 52 connected to the first end of the barrel 70 and the conveying pipe 23 of the air valve 20, a passage 51 to allow passage of the push rod 40 and a tapered drain hole 53 for mounting the safety valve 60 and connected between the first end of the barrel 70 and the outside of the gun body 10.

The safety valve 60 having a tapered shape is movably mounted in the drain hole 53 of the connecting base 50 and has a first end protruded outward from the gun body 10, and a spring 61 is mounted in the drain hole 53 of the connecting base 50 and rested on a second end of the safety valve 60 to push the safety valve 60 outward from the gun body 10.

The pull handle 401 of the push rod 40 has a side formed with a push portion 402 movable to push the first end of the safety valve 60.

The first locking ring 72 is retained on the connecting base 50 by a retaining plate 73 and is screwed onto the first end of the barrel 70 so that the barrel 70 is mounted on the gun body 10. The retaining plate 73 has a plurality of through holes 730 connected to the passage 51, the conduit 52 and the drain hole 53 of the connecting base 50.

Figure 5:
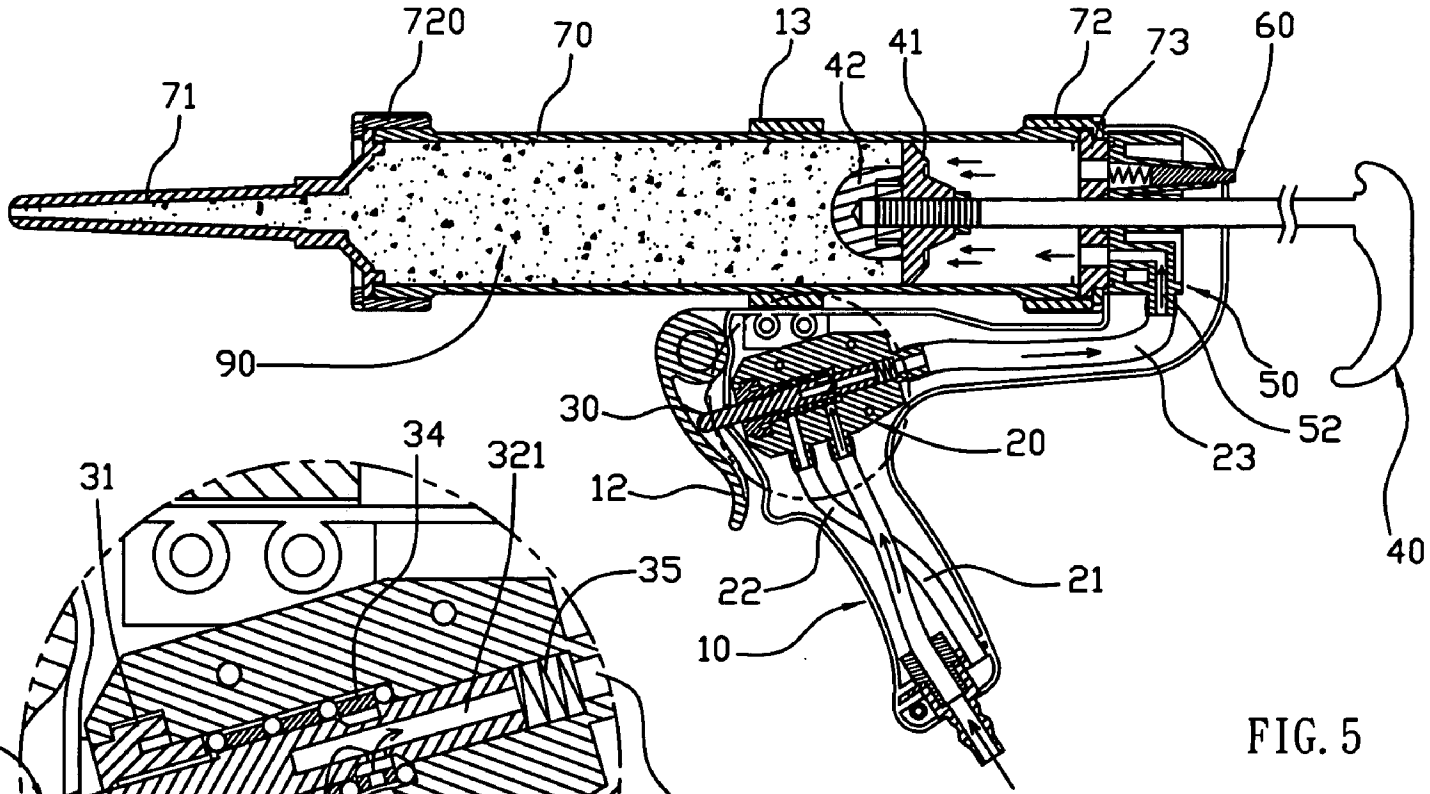
FIG. 5 is a schematic operational view of the pneumatic caulking gun as shown in FIG. 3.
Figure 6:
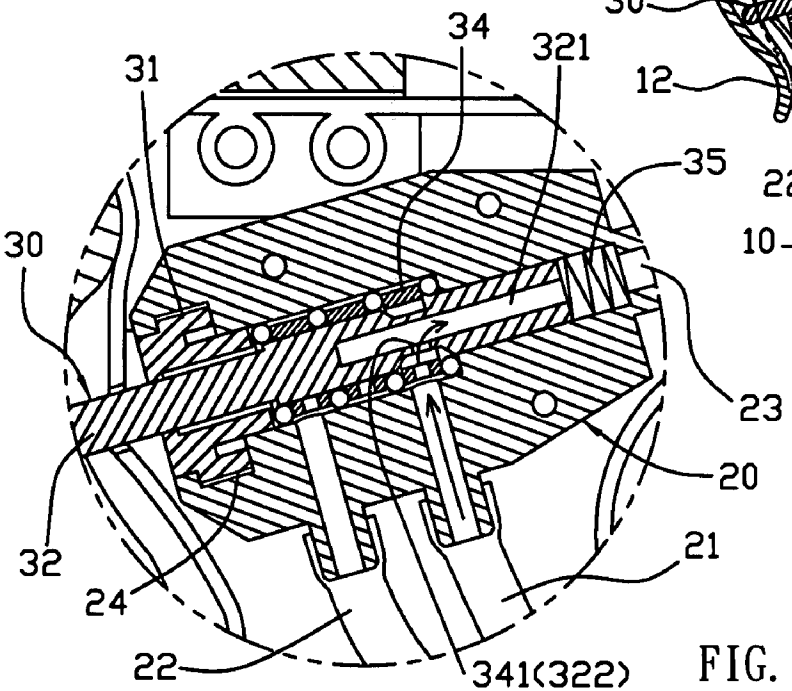
FIG. 6 is a locally enlarged view of the pneumatic caulking gun as shown in FIG. 5.

Referring to FIGS. 5 and 6, the barrel 70 contains a silicone gel 90 which is compressed and sealed between the nozzle 71 of the barrel 70 and the push plate 41. When the trigger 12 is pressed, the press knob 32 of the control unit 30 is pushed inward to a position where the connecting hole 322 of the press knob 32 is connected to the air inlet pipe 21 of the air valve 20, so that the pressurized air from the pneumatic source in turn flows through the air inlet pipe 21 of the air valve 20, the connecting hole 322 and the air hole 321 of the press knob 32, the conveying pipe 23 of the air valve 20, the conduit 52 of the connecting base 50 and the retaining plate 73 into the first end of the barrel 70 to push the push plate 41 forward to compress and squeeze the silicone gel 90, thereby injecting the silicone gel 90 outward from the nozzle 71 of the barrel 70 for use with a user.

Figure 7:
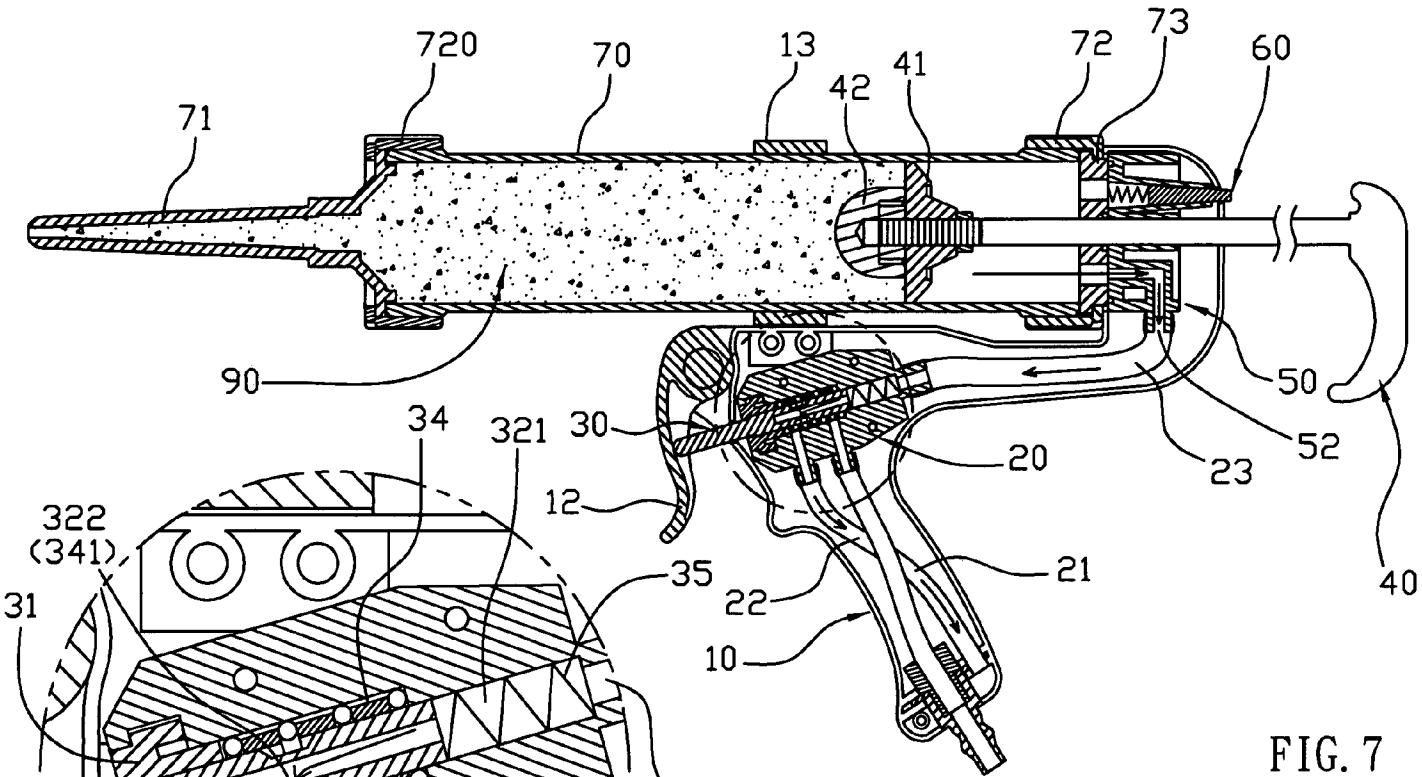
FIG. 7 is a schematic operational view of the pneumatic caulking gun as shown in FIG. 5.
Figure 8:
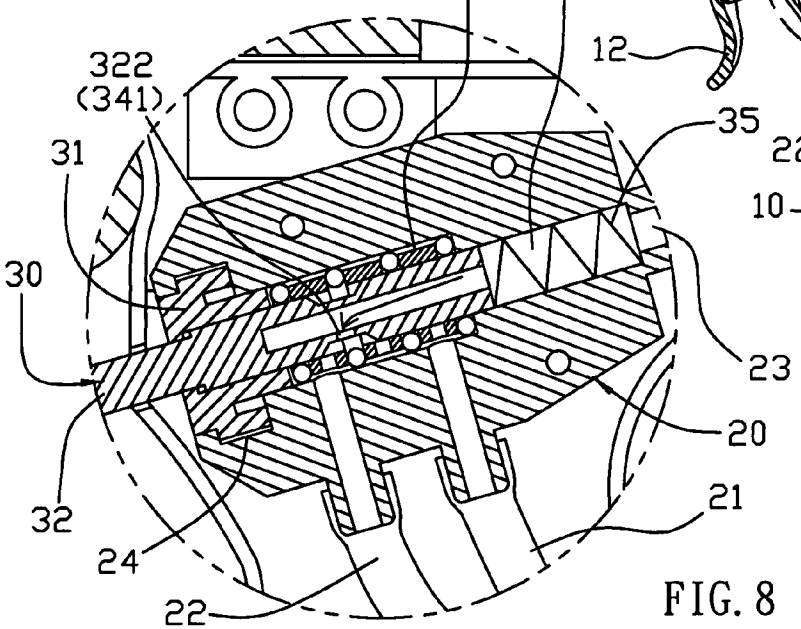
FIG. 8 is a locally enlarged view of the pneumatic caulking gun as shown in FIG. 7.

Referring to FIGS. 7 and 8, when the force applied on the trigger 12 is removed, the press knob 32 of the control unit 30 is pushed outward by the restoring force of the spring 35 to a position where the connecting hole 322 of the press knob 32 is connected to the air outlet pipe 22 of the air valve 20, so that the pressurized air from the first end of the barrel 70 in turn flows through the retaining plate 73, the conduit 52 of the connecting base 50, the conveying pipe 23 of the air valve 20, the air hole 321 and the connecting hole 322 of the press knob 32 and the air outlet pipe 22 of the air valve 20, and is drained outward from the air outlet pipe 22 of the air valve 20.

Figure 9:
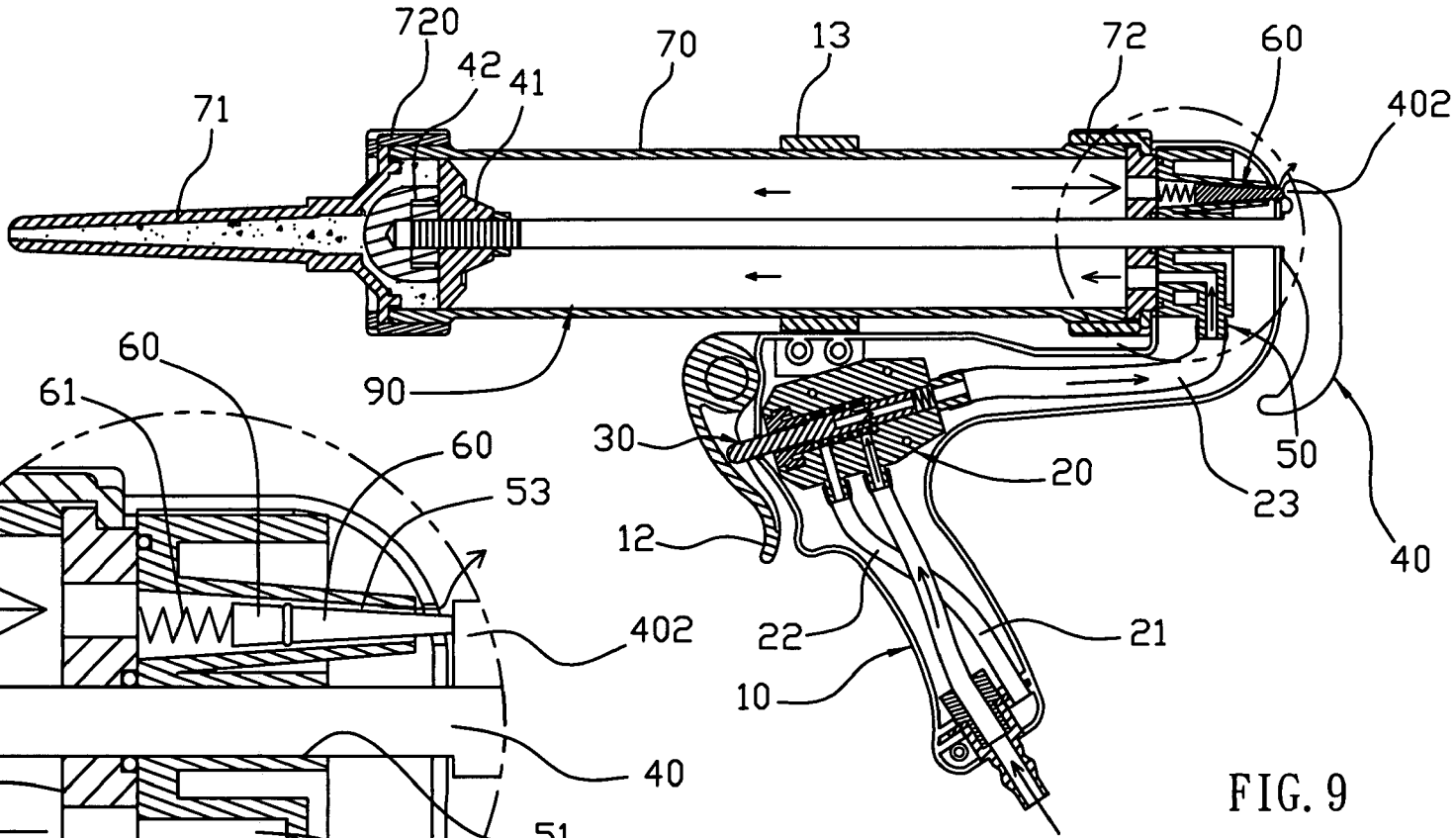
FIG. 9 is a schematic operational view of the pneumatic caulking gun as shown in FIG. 5.
Figure 10:
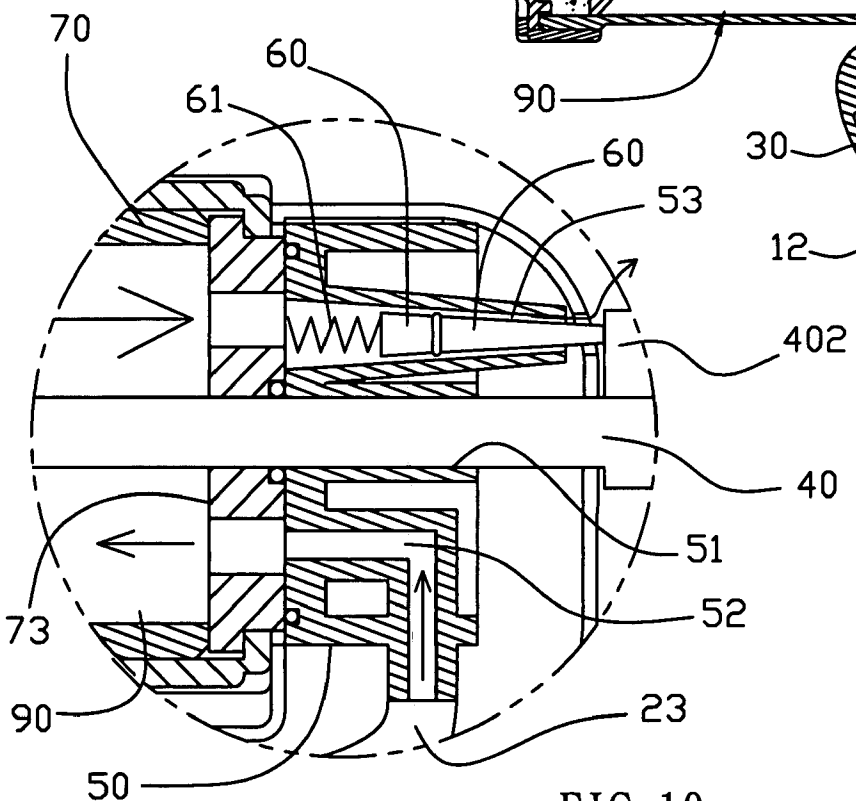
FIG. 10 is a locally enlarged view of the pneumatic caulking gun as shown in FIG. 9.

Referring to FIGS. 9 and 10, when the push plate 41 reaches the second end of the barrel 70 until the silicone gel 90 is exhausted, the push portion 402 of the push rod 40 is movable to push the first end of the safety valve 60 to retract the safety valve 60 into the drain hole 53 of the connecting base 50, thereby opening the drain hole 53 of the connecting base 50 so as to connect the first end of the barrel 70 to the outside of the gun body 10, so that the pressurized air from the first end of the barrel 70 is drained outward the drain hole 53 of the connecting base 50, thereby preventing the barrel 70 from producing a gas explosion.

Accordingly, the trigger 12 is pressed to fill the pressurized air with the barrel 70 successively to push the push plate 41 forward to compress and squeeze the silicone gel 90, thereby injecting the silicone gel 90 outward from the nozzle 71 of the barrel 70 automatically. In addition, the user only needs to slightly press the trigger 12 by his one hand to squeeze the silicone gel 90 outward, thereby facilitating the user operating the caulking gun, and thereby saving the manual work. Further, the silicone gel 90 is squeezed outward automatically, so that the silicone gel 90 is injected onto an object in an evenly distributed manner, thereby enhancing the working efficiency of the caulking gun. Further, when the silicone gel 90 is exhausted, the push portion 402 of the push rod 40 is movable to push the safety valve 60, thereby opening the drain hole 53 of the connecting base 50, so that the pressurized air from the barrel 70 is drained outward from the drain hole 53 of the connecting base 50, thereby preventing the barrel 70 from producing a gas explosion.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A pneumatic caulking gun, comprising:

a gun body;

an air valve mounted in the gun body and provided with an air inlet pipe, an air outlet pipe and a conveying pipe;

a control unit movably mounted in the air valve to control connection of the conveying pipe with the air inlet pipe and the air outlet pipe;

a trigger pivotally mounted on the gun body and pressed on the control unit to control movement of the control unit;

a barrel mounted on the gun body and having a first end connected to the conveying pipe of the air valve and a second end provided with a nozzle; wherein the air valve has an inside formed with a valve chamber for mounting the control unit and connected to the air inlet pipe, the air outlet pipe and the conveying pipe;

the control unit includes a press knob movably mounted in the valve chamber of the air valve and having a first end having an inside formed with an air hole connected to the conveying pipe of the air valve and a side formed with a connecting hole connected to the air hole and movable to selectively connect either one the air inlet pipe and the air outlet pipe of the air valve.

2. The pneumatic caulking gun in accordance with claim 1, further comprising a connecting base mounted on the gun body and connected between the first end of the barrel and the conveying pipe of the air valve.

3. The pneumatic caulking gun in accordance with claim 2, wherein the connecting base has an inside formed with a conduit connected to the first end of the barrel and the conveying pipe of the air valve.

4. The pneumatic caulking gun in accordance with claim 1, wherein the press knob of the control unit has a second end protruded outward from the air valve and rested on the trigger.

5. The pneumatic caulking gun in accordance with claim 1, wherein the control unit further includes a plurality of spacer rings and O-rings mounted on the press knob and arranged in a staggered manner.

6. The pneumatic caulking gun in accordance with claim 5, wherein each of the spacer rings of the control unit is formed with a through hole connected to either one of the air inlet pipe and the air outlet pipe of the air valve respectively.

7. The pneumatic caulking gun in accordance with claim 1, wherein the control unit further includes a spring biased between the first end of the press knob and the valve chamber of the air valve.

8. The pneumatic caulking gun in accordance with claim 1, wherein the control unit further includes an end cap mounted on the press knob and secured in the valve chamber of the air valve.

9. The pneumatic caulking gun in accordance with claim 2, further comprising a safety valve mounted on the connecting base and partially protruded outward from the gun body.

10. The pneumatic caulking gun in accordance with claim 9, wherein the connecting base has an inside formed with a tapered drain hole for mounting the safety valve and connected between the first end of the barrel and an outside of the gun body.

11. The pneumatic caulking gun in accordance with claim 10, wherein the safety valve has a tapered shape.

12. The pneumatic caulking gun in accordance with claim 10, wherein the safety valve is movably mounted in the drain hole of the connecting base and has a first end protruded outward from the gun body, and the pneumatic caulking gun further comprises a spring mounted in the drain hole of the connecting base and rested on a second end of the safety valve to push the safety valve outward from the gun body.

13. The pneumatic caulking gun in accordance with claim 12, further comprising a push plate movably mounted in the barrel, and a push rod movably mounted on the gun body and having a first end secured to the push plate to move therewith and a second end provided with a pull handle having a side formed with a push portion movable to push the first end of the safety valve.

14. The pneumatic caulking gun in accordance with claim 13, wherein the connecting base has an inside formed with a passage to allow passage of the push rod.

15. The pneumatic caulking gun in accordance with claim 13, wherein when the push plate reaches the second end of the barrel, the push portion of the push rod is movable to push the first end of the safety valve to retract the safety valve into the drain hole of the connecting base, thereby opening the drain hole of the connecting base to connect the first end of the barrel to the outside of the gun body.

16. The pneumatic caulking gun in accordance with claim 1, wherein the barrel is mounted on the gun body by a first locking ring, and the nozzle is mounted on the barrel by a second locking ring, and the first locking ring is retained on the connecting base by a retaining plate and is screwed onto the first end of the barrel so that the barrel is mounted on the gun body.

17. The pneumatic caulking gun in accordance with claim 16, wherein the gun body is provided with a handle, the trigger is pivotally mounted on the handle of the gun body, the air inlet pipe and the air outlet pipe of the air valve are mounted in the handle of the gun body by a fixing plate and connected to an outside of the gun body, and the air inlet pipe of the air valve has a distal end protruded outward from the handle of the gun body and provided with a connector for connection to a pneumatic source.

18. The pneumatic caulking gun in accordance with claim 1, further comprising a mounting ring fixed on the gun body and mounted on the barrel to support the barrel on the gun body.

* * * * *